US010823521B2

(12) United States Patent
An et al.

(10) Patent No.: US 10,823,521 B2
(45) Date of Patent: Nov. 3, 2020

(54) APPARATUS AND METHOD FOR DESIGNING RIFLING RATE TO INCREASE LIFESPAN OF GUN BARREL

(71) Applicant: AGENCY FOR DEFENSE DEVELOPMENT, Daejeon (KR)

(72) Inventors: Seil An, Daejeon (KR); Yunjung Oh, Daejeon (KR); Ki-Up Cha, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 0 days.

(21) Appl. No.: 16/423,392

(22) Filed: May 28, 2019

(65) Prior Publication Data

US 2020/0149835 A1 May 14, 2020

(30) Foreign Application Priority Data

Nov. 9, 2018 (KR) ..... 10-2018-0137275

(51) Int. Cl.
*F41A 21/18* (2006.01)

(52) U.S. Cl.
CPC ..... *F41A 21/18* (2013.01)

(58) Field of Classification Search
CPC ..... F41A 21/18; F41A 21/16; H01Q 13/0208; H01Q 25/001
USPC ..... 42/78
See application file for complete search history.

(56) References Cited

U.S. PATENT DOCUMENTS

| | | | | |
|---|---|---|---|---|
| H000278 | H * | 6/1987 | Steiner | 42/77 |
| 4,924,614 | A | 5/1990 | Hoffmann et al. | |
| 5,337,504 | A | 8/1994 | Krumm | |
| 5,765,303 | A * | 6/1998 | Rudkin, Jr. | F41A 21/18 42/78 |
| 5,907,921 | A * | 6/1999 | Rose | F41C 27/22 42/76.01 |
| 8,635,797 | B2 * | 1/2014 | Cha | F41A 21/18 42/76.1 |
| 9,136,606 | B2 | 9/2015 | Simon et al. | |
| 2018/0017350 | A1 * | 1/2018 | Kowalski | B32B 9/041 |
| 2020/0166304 | A1 * | 5/2020 | Martin | F41A 21/30 |

FOREIGN PATENT DOCUMENTS

| | | | |
|---|---|---|---|
| JP | 3626348 | B2 | 3/2005 |
| KR | 10-2012-0088306 | A | 8/2012 |
| KR | 10-2015-0062461 | A | 6/2015 |

OTHER PUBLICATIONS

KiUp Cha et al., "A Study on the Design of Rifling Angle by Setting up an Idealized Rifling Force Curve", Journal of the KIMST, vol. 18, No. 1, pp. 15-21, 2015.

* cited by examiner

*Primary Examiner* — Michael D David
(74) *Attorney, Agent, or Firm* — LRK Patent Law Firm

(57) ABSTRACT

An apparatus for designing a rifling rate to increase a lifespan of a gun barrel includes: a node selection module selecting and distributing the predetermined number of node points according to preset constraints between preselected starting and end rifling angles; a sorting module sorting distributed node points; and a profile generation module calculating a rifling rate curve using sorted node points, and generating a rifling rate profile using the rifling rate curve.

9 Claims, 9 Drawing Sheets

APPARATUS AND METHOD FOR DESIGNING RIFLING RATE TO INCREASE LIFESPAN OF GUN BARREL

CROSS REFERENCE TO RELATED APPLICATION(S)

This application claims the benefit of Korean Patent Application No. KR 10-2018-0137275, filed Nov. 9, 2018, which is hereby incorporated by reference in its entirety into this application.

BACKGROUND OF THE INVENTION

1. Technical Field

The present invention relates to a gun barrel technology and, more particularly, to an apparatus and method for designing a rifling rate profile of an artillery to increase a lifespan of a gun barrel.

2. Description of Related Art

Because rifling force acting on a projectile when the projectile passes through a gun barrel is given as a function of a rifling angle $\alpha$ and a rifling angle change rate $\alpha'$, it is possible to prevent the rifling force from being concentrated on a specific position of the gun barrel by designing the rifling rate to be appropriately changed from a breech to a muzzle.

However, at the same time, in order for the projectile to fly steadily, a certain rifling rate should be accomplished at the muzzle.

Conventionally, for the sake of convenience in production and simplicity in a design, a fixed type or function increasing type rifling was mainly used. The fixed type rifling consists of only specific rifling rate from a muzzle to a breech, and the function increasing type rifling is composed of a rifling rate profile mainly by using a linear or an exponential function.

However, in this case, it may be said that an optimal effect of rifling force reduction was not possible to be drawn as the design was simple. Thereafter, a method for designing a rifling was proposed in a form of Fourier series or Fourier series combined with a polynomial.

That is, the optimization algorithm was applied to prevent the rifling force from being concentrated at one part over the all area of the gun barrel. In addition, in order to solve the boundary condition, which was a disadvantage of the method using Fourier series, the form of Fourier series combined with a polynomial was additionally proposed.

Nevertheless, this method had a disadvantage that monotone increasing of the rifling rate profile was not guaranteed, and curvature of the profile was not possible to be controlled.

Meanwhile, several ideas were proposed such that a heuristic optimization method was applied to minimize the maximum rifling force, thereby solving the problem.

However, there is a drawback that it is difficult to apply analytical method because of strong nonlinearity of a diagram for the velocity and gun barrel pressure with respect to a gun barrel length included in an objective function.

SUMMARY OF THE INVENTION

The present invention has been proposed in order to solve a problem according to the above related art, and an object of the present invention is to provide an apparatus and method for designing a rifling rate to increase a lifespan of a gun barrel, the apparatus and method being capable of creating a curve increasing smoothly from a low rifling rate at a breech to a final rifling rate at a muzzle in order to prevent a phenomenon that high rifling force is concentrated on a specific part of a gun barrel during firing.

The present invention provides an apparatus for designing a rifling rate to increase a lifespan of a gun barrel to achieve the objective presented above, the apparatus being capable of creating a curve increasing smoothly from a low rifling rate at a breech to a final rifling rate at a muzzle in order to prevent a phenomenon that high rifling force is concentrated on a specific part of a gun barrel during firing.

The apparatus for designing a rifling rate may include a node selection module selecting and distributing a predetermined number of node points according to preset constraints between preselected starting and end rifling angles; a sorting module sorting distributed node points; and a profile generation module calculating a rifling rate curve using sorted node points, and generating a rifling rate profile using the rifling rate curve.

In addition, the apparatus for designing a rifling rate may further include an evaluation module capable of determining how much the generated rifling rate profile reduces maximum rifling force from the preset maximum rifling force In addition, the distributed node points are randomly arranged at the beginning and then re-sorting thereof is performed.

Here, the re-sorting is to arrange the distributed node points being randomly arranged in order of size.

In addition, by applying a piecewise cubic Hermite interpolating polynomial (PCHIP), the rifling rate curve has node points where a slope is given to be continuous at an individual node point and has a characteristic that monotone increasing is guaranteed.

In addition, the constraints are each that slopes of the starting and end rifling angles are zero.

In addition, the sorting is accomplished by applying a covariance matrix adaptation-evolutionary strategy (CMA-ES) algorithm.

In addition, the rifling rate profile passes through node points fixed at specific positions predetermined to add a partially fixed type rifling from the vicinity of the muzzle.

On the other hand, another embodiment of the present invention provides a method for designing a rifling profile to increase a lifespan of a gun barrel, the method including: (a) selecting and distributing the predetermined number of node points according to preset constraints between preselected starting and end rifling angles by a node selection module; (b) sorting distributed node points by a sorting module; and (c) calculating a rifling rate curve using sorted node points, and generating a rifling rate profile using the rifling rate curve by a profile generation module.

An advantage of the present invention resides in that the rifling rate designed according to the present invention does not experience a phenomenon that the rifling rate designed according to a Fourier approach increases and again decreases.

Another advantage of the present invention is recognized as an effect that the rifling force is reduced as the proposed method has, on the whole, a slightly smaller or similar rifling force compared with the conventional method.

Still another advantage of the present invention is noted that the curvature of the profile can be adjusted by adjusting the number of nodes.

A further advantage of the present invention is noted that it is also possible to generate a profile that necessarily passes through specific points by fixing nodes to desired positions, and the nodes can be utilized in case of adding a partially fixed type rifling from the vicinity of a muzzle for the stability of a projectile behavior.

DESCRIPTION OF THE PREFERRED EMBODIMENTS

Figure 1:
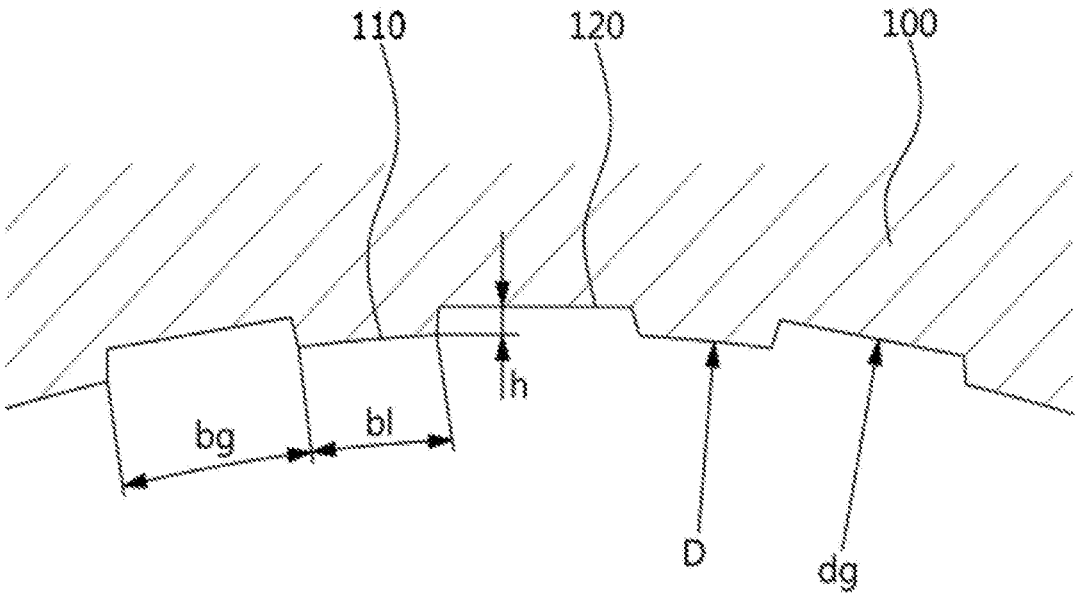
FIG. 1 is a sectional view of a typical rifling.

As the invention is adaptable to various modifications and alternative forms, specific embodiments thereof are illustrated by way of examples in the drawings and will herein be described in detail.

However, it should be understood that the invention is not intended to be limited to the particular embodiments, but includes all modifications, equivalents, and alternatives falling within the spirit and technical scope of the invention.

In describing each drawing, like reference numerals are used for similar elements. The terms first, second, etc. may be used to describe various components, but the components should not be limited by the terms. The terms are used only for the purpose of distinguishing one component from another.

For example, without departing from the scope of the present invention, the first component may be referred to as a second component, and similarly, the second component may also be referred to as a first component. The term "and/or" includes any combination of a plurality of related listed items or any one of the plurality of related listed items.

Unless defined otherwise, all terms used herein, including technical or scientific terms, have the same meaning as commonly understood by those of ordinary skill in the art to which this invention belongs.

Terms such as those defined in commonly used dictionaries are to be interpreted as having a meaning consistent with the contextual meaning of the related art and are to be interpreted as neither ideal nor overly formal in the sense of the present application, unless defined explicitly in the present application.

Hereinafter, an apparatus and method for designing a rifling rate profile to increase a lifespan of a gun barrel according to an embodiment of the present invention will be described in detail with reference to the accompanying drawings.

FIG. 1 is a sectional view of a typical rifling. With reference to FIG. 1, a rifling 100 of the gun barrel has a concave-convex structure in which a groove portion 120 and a land portion 110 are repeatedly provided. The land portion 110 is provided with a land width bl and the groove portion 120 is provided with a groove width bg and a groove depth h. A distance from a center of the gun barrel to the groove portion 120 is a diameter above the groove dg and a distance from the center of the barrel to the land portion 110 is a caliber D.

Accordingly, the rifling may be said to be a kind of concave-convex that is made to allow the projectile to be rotated by being tightly engaged with the rifling and to proceed along a gun barrel.

Figure 2A:
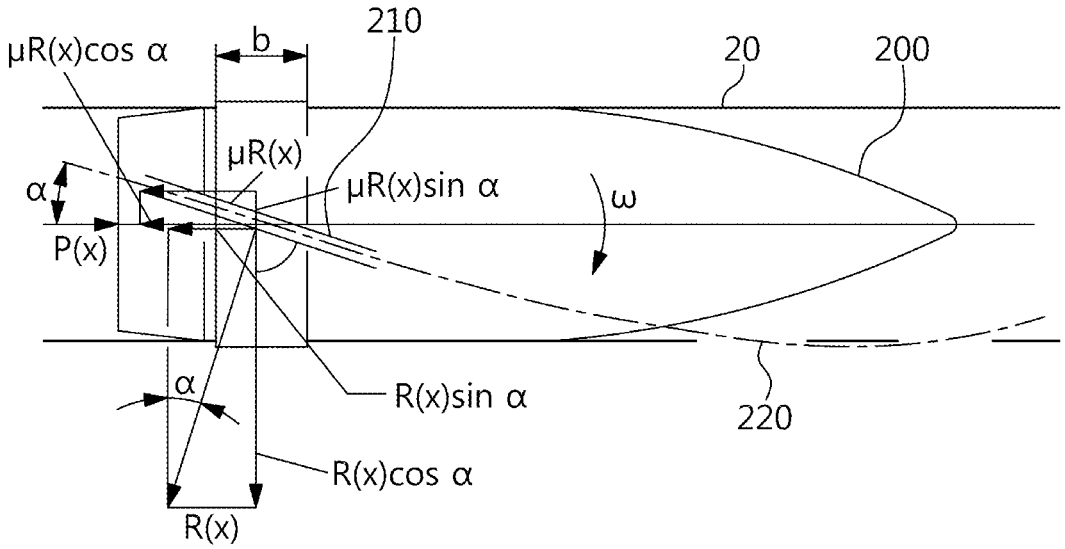
FIG. 2A is a conceptual view illustrating force generated between a typical projectile and a rifling when the typical projectile travels through a bore due to force of a propulsion gas.
Figure 2B:
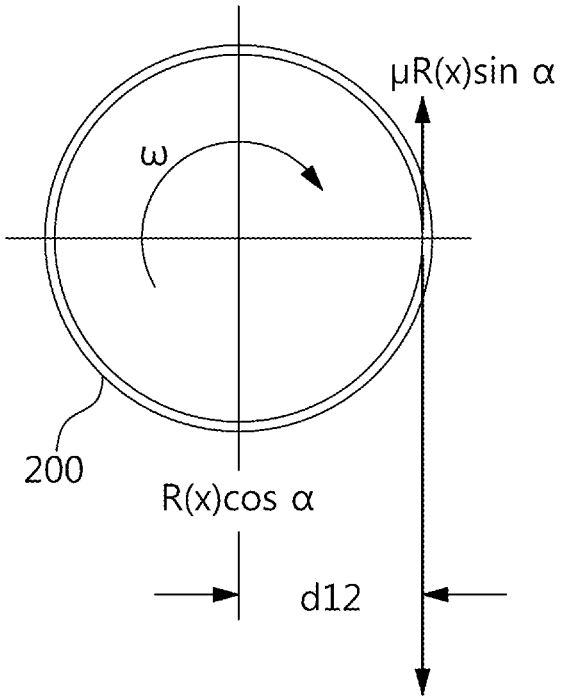
FIG. 2B is a sectional view of the projectile illustrated in FIG. 2A.

FIG. 2A is a conceptual view illustrating force generated between a typical projectile and a rifling when the typical projectile travels through a bore due to force of a propulsion gas, and FIG. 2B is a sectional view of the projectile illustrated in FIG. 2A. With reference to FIGS. 2A and 2B, when a firearm is fired while a projectile 200 is loaded into a gun barrel 20, the projectile 200 proceeds along a progressive path 220 at an angular velocity ω along a profile 210 formed on the gun barrel 20.

At this time, the force (receiving force) generated by forcibly rotating the projectile that is intended to proceed in a straight line is referred to as rifling force. The rifling force refers to the force acting in a shear direction in a vertical direction of the rifling when the projectile rotates along the rifling and travels through the bore. The force acting on the rifling as above has an effect to wear the rifling continuously. The rifling force (R (x)) may be expressed theoretically as the following equation.

$$R(x) = \frac{4}{D^2}\frac{J_p}{m_p}\left[\frac{dy}{dx}P(x) + \frac{d^2y}{dx^2}v(x)^2 m_p\right. \quad \text{[Equation 1]}$$

where, P(x) is force due to gun barrel pressure, x is a travel distance of the projectile, y is a rifling angle profile, D is a caliber, $m_p$ is mass of the projectile, $J_p$ is mass moment of inertia of the projectile, v(x) is a velocity of the projectile, wherein, in general, at a small rifling angle, the rifling rate $$\frac{dy}{dx}$$

has such a relation with a rifling angle α as $$\tan\alpha = \frac{dy}{dx}.$$

In the above equation, it may be confirmed that the rifling force is defined with the rifling angle, a derivative of the rifling angle, the gun barrel pressure, and the velocity of the projectile according to the travel distance of the projectile. In most firearms, the force P(x) due to the gun barrel pressure shows a decreasing tendency after rapidly reaching maximum pressure, and a curve of the velocity v(x) of the projectile shows an increasing tendency while an increasing rate thereof becomes low.

Because $dy/dx=\tan\alpha(x)\approx\alpha(x)$, it may be summarized as the following equation.

$$\frac{d^2y}{dx^2}=\frac{d\alpha(x)}{dx}\frac{a}{\cos^2\alpha(x)}\approx\frac{d\alpha(x)}{dx} \quad \text{[Equation 2]}$$

Because it is assumed that the force P(x) due to the gun barrel pressure and the velocity v(x) of the projectile do not change according to a change of the rifling rate, when the rifling angle profile that is a function of $\alpha(x)$ and $\alpha'(x)$ is appropriately designed through the above equation, it may be seen that the rifling force profile R(x) applied to the entire gun barrel may also be adjusted. Meanwhile, $\alpha'(x)$ represents a function that is the derivative of the rifling angle $\alpha(x)$.

Accordingly, in one embodiment of the present invention, a rifling rate is designed in the manner of dispersing the arbitrary number of node points on a rifling rate profile and linking the node points to obtain a smooth curve. In particular, an optimization algorithm is utilized to arrange the node points to attain a desired objective function (reduction of maximum rifling force). Then, an interpolation algorithm called piecewise cubic Hermite interpolating polynomial (PCHIP) is used to smoothly link node points from one to another.

In FIG. 2A, $\mu$ represents a friction coefficient, and b is a width of a rotating band.

Figure 3:
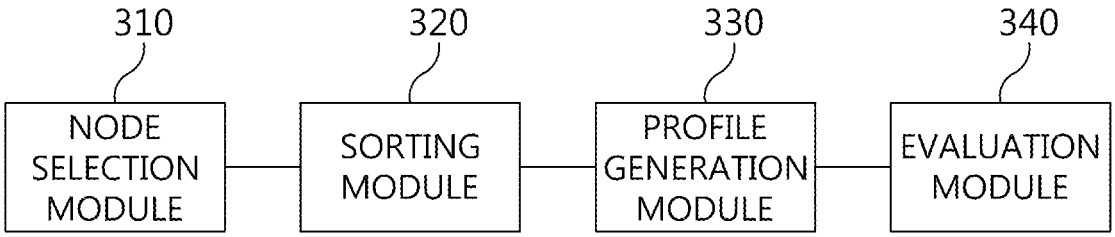
FIG. 3 is a block diagram of an apparatus for designing a rifling rate to increase a lifespan of a gun barrel according to an embodiment of the present invention.

FIG. 3 is a block diagram of an apparatus 300 for designing a rifling rate to increase a lifespan of a gun barrel according to an embodiment of the present invention. With reference to FIG. 3, the apparatus 300 for designing a rifling rate may include a node selection module 310 selecting and distributing the predetermined number of node points, a sorting module 320 sorting the distributed node points, a profile generation module 330 generating a rifling rate profile using the sorted node points, an evaluation module 340 evaluating the generated rifling rate profile, and the like.

The node selection module 310 selects and distributes the predetermined number of node points according to preset constraints between preselected starting and end rifling angles. In general, the constraints that may be applied in the problem for designing the rifling force profile are illustrated in the following table.

TABLE 1

| | Constraints |
|---|---|
| 1 | $\alpha' \geq 0$ |
| 2 | $\alpha(x_f) = \alpha_f$ |
| 3 | $\alpha(x_f) - \alpha(x_i) \leq \Delta\alpha_k$ |
| 4 | $\alpha'(x_f) = 0$ |
| 5 | $\alpha'(x_i) = 0$ |

Here, constraint 1 is $\alpha'\geq 0$, which means a monotone increasing of a rifling angle, constraint 2 means that an end rifling angle is fixed, constraint 3 means that a range of a rifling angle change is limited, and constraints 4 and 5 mean that the derivatives of the rifling angles at starting and end points of the rifling are each zeroes.

The rest of constraints except for item 1 in the above table are already applied to the incremental type rifling design methodology of a Fourier approach that was performed previously. The design of the optimum rifling rate may be regarded as a problem of reducing the maximum rifling force acting over a whole travel range of the projectile and of satisfying these constraints at the same time.

When a profile starts with a low rifling angle, it is possible to reduce the initial rifling force, but this inevitably leads to a situation where a large slope is necessary to be made up to the escape rifling angle. Therefore, it is important to select an appropriate starting rifling angle.

The monotone increasing of the constraint 1 is applied because, when the rotation velocity of the projectile increases and again decreases, an adverse effect is imposed on the rotating band. The rotating band made of brass is plastically deformed due to the rifling, thereby being engraved with a pattern similar to the rifling profile after escaping the rifling.

When the rifling angle is increased, plastic deformation occurs consistently to a larger angle. However, when the angle is decreased midway, force is applied again to the rotating band on which the plastic deformation has already occurred, thereby inducing a potential that the rotating band may disappear.

For this reason, designing a rifling angle to be decreased and again increased midway is not allowed. The corresponding constraint is an essential condition for designing and manufacturing an actual incremental type rifling, but there is a problem that the constraint may not be applied through an existing methodology.

The reason for making the escape rifling angle constant is to maintain a rotation velocity of a projectile at a predetermined appropriate value for the stability of a trajectory when the projectile finally escapes. The condition that limits a gap between the starting and escape rifling angles to be less than or equal to a predetermined value is to prevent the risk of damage to the rotating band due to the excessive change of rifling angle in a process that the projectile travels.

The rotating band is made of brass and is deformed into a rifling profile, thereby creating a rotation thereof. However, when the change of angle is greater than or equal to 5°, engraved parts capable of creating a rotation are abraded to disappear from the rotating band, thereby causing a phenomenon that the rotating band fails to play a role thereof.

In the case of constraints 4 and 5, an effect of the derivative of the rifling angle at each of the starting and end points of the rifling has not been identified, but these constraints are applied considering the safety factor against the error in a machining process of the rifling.

Accordingly, the constraints described in Table 1 above may also be additionally satisfied in an embodiment of the present invention.

With reference to FIG. 3, the sorting module 320 performs a function to sort the distributed node points. The node points arranged freely initially are sorted to produce a curve of the rifling rate that reduces the maximum rifling force through an optimization algorithm. Because the number of node points may not be enormously increased in consideration of design precision limitations, a high-level (high-dimensional) optimization algorithm is not required. However, because the process of sorting the node points in order of size is involved, the method using a gradient is impossible to apply for optimization.

Therefore, in the case of an embodiment of the present invention, a covariance matrix adaptation-evolutionary strategy (CMA-ES) is used as an optimization algorithm. The use of the CMA-ES may be said to be suitable for one embodiment of the present invention, which deals with the simultaneous optimization of ten or more coefficients, by a predicted solution variance method, which is similar to particle swarm optimization (PSO).

The CMA-ES is a kind of a distributed optimization algorithm and defines the solution variance method as an evolutionarily changing mean and covariance. Typically, in a distributed optimization algorithm to which the PSO is applicable, one or several times of processes sowing multiple initial solutions (seeds) are passed through. In the CMA-ES, the initial solution is distributed in the process above using a multivariate normal distribution defined by a mean and covariance.

Then, the mean and covariance are changed by using top 60% solutions in a set of distributed predicted solutions. When a solution exists within a search range, a method like this allows the solution distribution to be converged by quickly reducing the covariance of the solution distribution. In addition, when local solutions occur, the method passes through a process finding the solution continuously by maintaining or increasing the covariance.

With reference to FIG. 3 in succession, the profile generation module 330 calculates a rifling rate curve using the sorted node points, and performs a function to generate a rifling rate profile using the rifling rate curve.

In the case of using a node-point-based design method for the design of the rifling rate profile, when the path optimization problem such as the rifling angle design problem is substituted with a problem of setting intermediate nodes of the path, the path optimization problem may be substituted with a parameter optimization problem. The PCHIP is used to link each of the node points to become a smooth curve. The above method links each of the points while making it possible to perform the first order differentiation therefor and guarantees the monotone increasing of each of the points. The nodes between the starting and end parts of the path are randomly arranged at the beginning and then work is performed to re-sort the nodes in order of size.

Yet another advantage of the rifling rate profile design of the above method is a feature capable of giving an effect changing the curvature of the rifling rate profile through the number of node points. The accuracy of the process in the manufacturing of the rifling of the actual gun barrel may be limited by the number of node points. It may be possible to change the curvature of the profile while taking the precision of the process into consideration via the method presented through one embodiment of the present invention.

The constraints presented in Table 1 may be defined again by adding specific node points to the starting and end rifling angles, respectively, using a fact that the slope is given to be continuous at individual node and the rifling rate curve has a characteristic of monotone increasing, which are attained by applying the PCHIP. The constraints illustrating this relation are provided in Table 2. Meanwhile, Table 2 relates to settings of node points.

TABLE 2

| | Constraints | Settings |
|---|---|---|
| 1 | $\alpha(x_f) = \alpha_f$ | $\alpha_1(x_1), \ldots, \alpha_n(x_n), \alpha_f$ |
| 2 | $\alpha(x_i) = \alpha_i$ | $\alpha_i, \alpha_1(x_1), \ldots, \alpha_n(x_n), \alpha_f$ |

TABLE 2-continued

| | Constraints | Settings |
|---|---|---|
| 3 | $\alpha'(x_f) = 0$ | $\alpha_i, \alpha_1(x_1), \ldots, \alpha_n(x_n), \alpha_{f,1}, \alpha_{f,2}$ |
| 4 | $\alpha'(x_i) = 0$ | $\alpha_{i,1}, \alpha_{i,2}, \alpha_1(x_1), \ldots, \alpha_n(x_n), \alpha_{f,1}, \alpha_{f,2}$ |

Table 2 is an example of settings of node points. Here, constraint 1 is a node point setting condition to fix the end rifling angle to a specific value, constraint 2 is a node point setting condition to fix the starting rifling angle to a specific value, constraint 3 is a node point setting condition to enforce the slope of the end rifling angle to be zero, and constraint 4 is a node point setting condition to enforce the slope of the starting rifling angle to be zero.

Accordingly, Table 2 above shows that node points are added according to the additionally given constraints, thereby satisfying the constraints. Due to the nature of the monotone increasing function, two points of the same value compose a straight line with a slope of zero. By using the above nature, it is possible to apply the constraints on the slope to the starting and end rifling angles, respectively.

As summarized above, various constraints are satisfied from the time when the node points are being arranged, whereby the objective function may be used without modification from the originally defined one. Accordingly, it may be expressed as a general maximum minimization problem as shown in the following equation.

$$\text{minimize } J, J=\max[R(x)], x\in[x_i, x_f] \quad \text{[Equation 3]}$$

where J is the objective function to be optimized. Therefore, equation 3 means that reducing the maximum value in the rifling force profile is the objective for designing the present rifling rate. To explain in more detail, as the peak in the rifling force profile is continuously limited not to be increased, the rifling force profile naturally becomes a shape of a plateau of which top is flat.

With reference to FIG. 3 in succession, the evaluation module 340 may determine how much the generated rifling rate profile reduces maximum rifling force from the preset maximum rifling force. In other words, the evaluation module 340 may evaluate the maximum rifling force reduction effect of the corresponding rifling rate profile by calculating the maximum rifling force acting on the actual gun barrel from the rifling rate profile generated through the theoretical calculation of equations 1 and 2. Meanwhile, the maximum rifling force reduction effect may reach up to about 38%.

Figure 4:
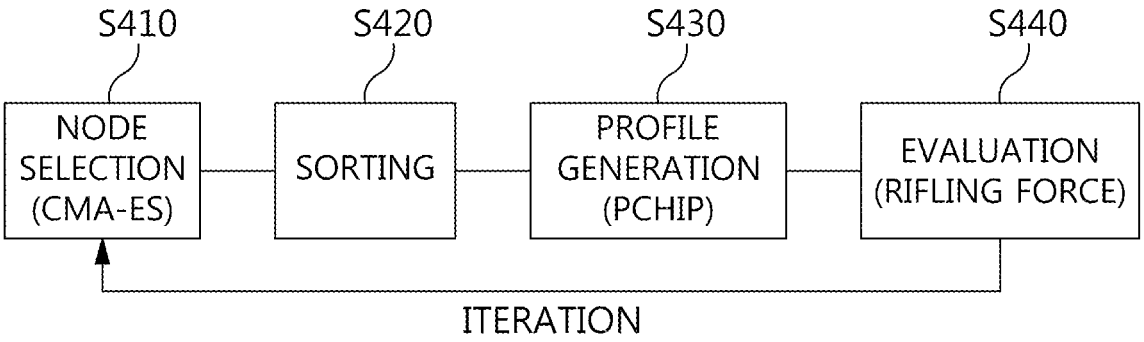
FIG. 4 is a flowchart illustrating a process for designing a rifling profile to increase a lifespan of a gun barrel according to an embodiment of the present invention.

The reduction of the maximum rifling force is achieved through an iteration process of a profile generation, an evaluation, and the like as illustrated in FIG. 4.

The term "module" illustrated in FIG. 3 means a unit processing at least one function or operation, and may be implemented by a combination of hardware and/or software. The hardware may be implemented as an application specific integrated circuit (ASIC), digital signal processing (DSP), a programmable logic device (PLD), a field programmable gate array (FPGA), a processor, a controller, a microprocessor, other electronic unit, or a combination thereof, each of which is designed to perform the above-described functions. The software may be implemented as a module that performs the above-described functions. Meanwhile, the software may be stored in a memory unit and executed by a processor. The memory unit or processor may employ various means well known to those skilled in the art.

FIG. 4 is a flowchart illustrating a process for designing a rifling profile to increase a lifespan of a gun barrel according to an embodiment of the present invention. With reference to FIG. 4, in step S410, the node selection module 310 selects and distributes the predetermined number of node points according to the preset constraints between the preselected starting and end rifling angles.

Thereafter, in step S420, the sorting module 320 sorts the distributed node points.

Thereafter, in step S430, the profile generation module 330 calculates a rifling rate curve using the sorted node points, and generates a rifling rate profile using the rifling rate curve.

Thereafter, in step S440, the evaluation module 340 evaluates the generated rifling rate profile and steps S410 to S430 are iterated.

Figure 5:
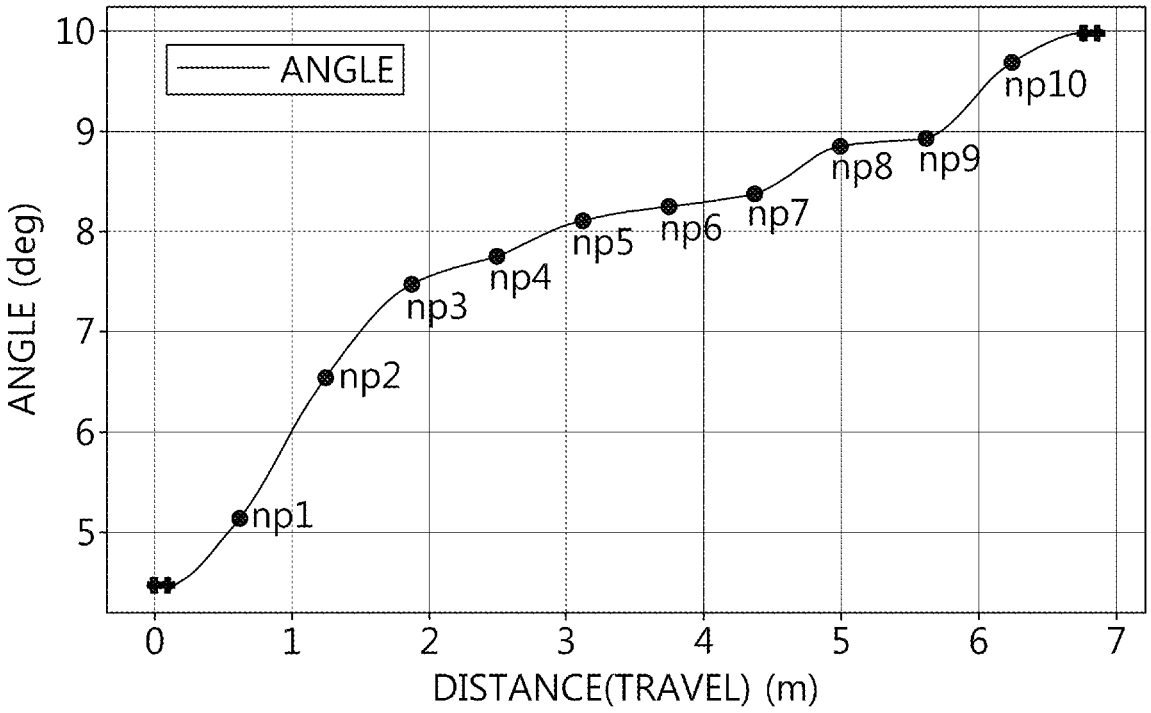
FIG. 5 is a graph illustrating an initial node arrangement and an initial rifling rate profile according to an embodiment of the present invention.

FIG. 5 is a graph illustrating an initial node arrangement and an initial rifling rate profile according to an embodiment of the present invention. With reference to FIG. 5, the arbitrary number of node points is arranged and a smooth curve (rifling rate profile) linking corresponding node points is generated using the PCHIP. In this process, the operation of arranging the node points (np1 to np10) from the initial low rifling angle to the end rifling angle in order is performed. That is, a sorting operation is performed.

In FIG. 5, the starting rifling angle, which is the first rifling angle, and the end rifling angle, which is the last rifling angle, are given constraints requiring a slope of each of the both rifling angles to become zero. Basically, as an incremental type rifling rate design is dealt with here, a slope of zero means that the rate of increase is zero. In other words, it means that the rifling rate becomes to have a shape being converged smoothly.

In addition, the end rifling angle is given to a specific value. These kinds of constraints may be given or omitted as needed.

Figure 6:
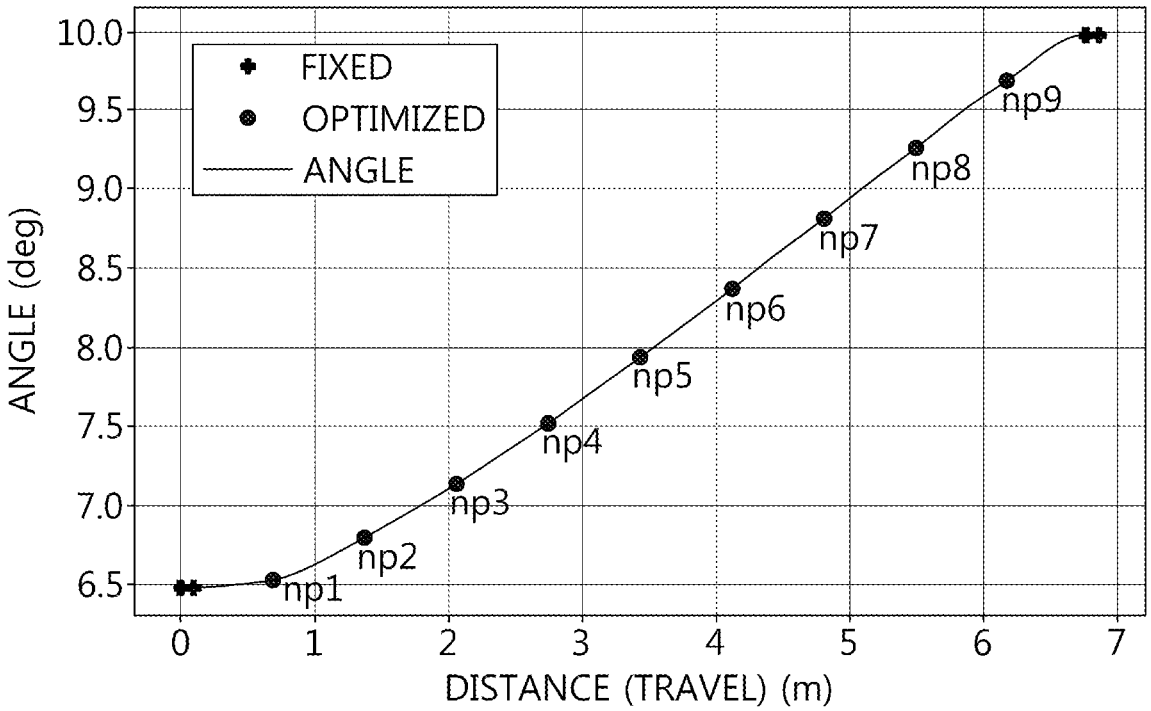
FIG. 6 is a graph illustrating an optimized node arrangement and a rifling rate profile illustrating a result that node points are arranged by applying an optimization algorithm according to an embodiment of the present invention.

FIG. 6 is a graph illustrating an optimized node arrangement and a rifling rate profile illustrating a result that node points are arranged by applying an optimization algorithm according to an embodiment of the present invention. With reference to FIG. 6, it is illustrated the result that node points are arranged so as not to allow the rifling force to be concentrated through the optimization algorithm. In the optimization algorithm, the objective function is set to minimize the maximum rifling force for the entire profile. That is, it is a matter of solving the minimax problem.

In the case of the optimization algorithm, various known algorithms may be applied. However, optimization of the method using the gradient is not appropriate because a case where differentiation is not applicable may arise in the process of adjusting the node points. In an embodiment of the present invention, a distributed optimization algorithm called the CMA-ES is used. However, the PSO, known often to be effective even though not being exactly the same method as one used in the embodiment of the present invention, may be used without any problem.

Figure 7:
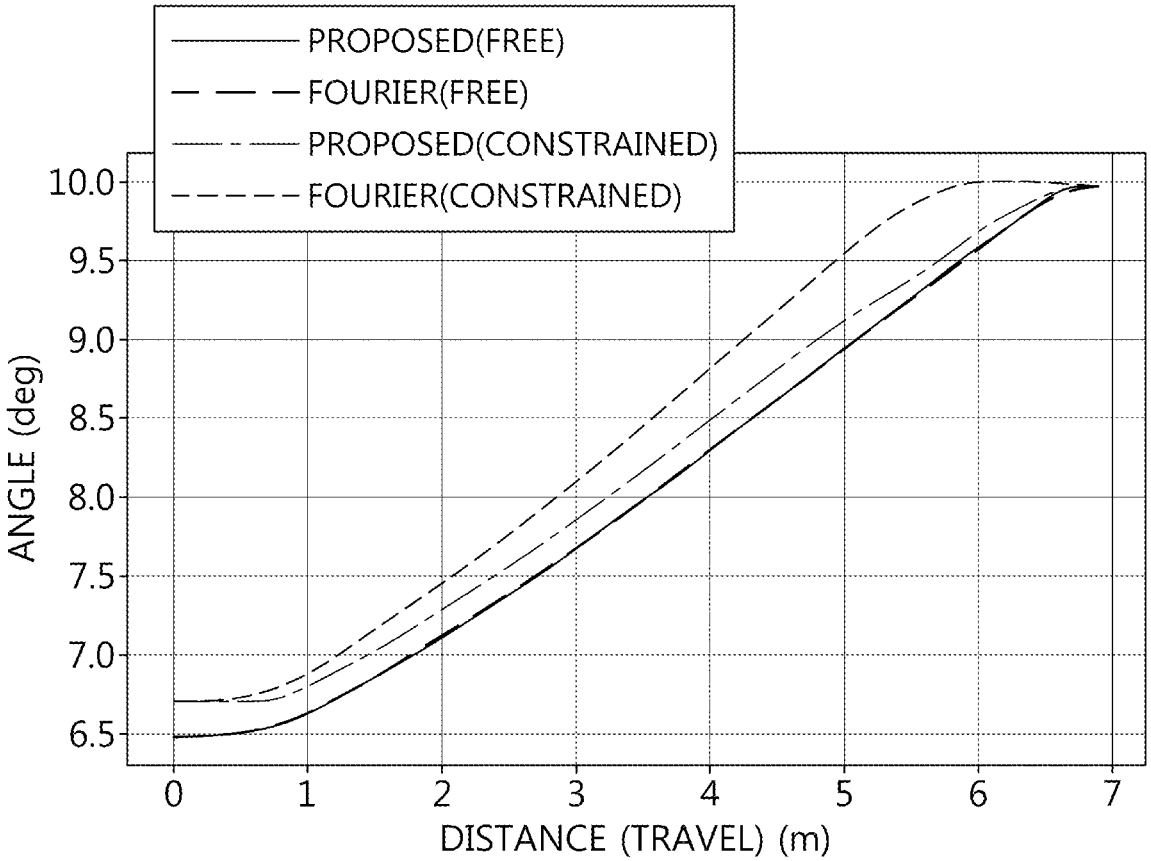
FIG. 7 is a graph comparing rifling rate profiles each according to a general methodology or an embodiment of the present invention.

FIG. 7 is a graph comparing rifling rate profiles each according to a general methodology or an embodiment of the present invention.

That is, FIG. 7 presents a result comparing the rifling rate profiles each according to a conventional design methodology of the Fourier function approach or an embodiment of the present invention. The Fourier function, which is combined with the sum of a plurality of trigonometric functions and convenient to produce smooth curve, is, however, difficult to guarantee monotone increasing within the profile for the Fourier function.

When the rifling angle is decreased after being increased in a process that the projectile proceeds, force is applied in an opposite direction on the rotating band on which the plastic deformation has already occurred, thereby inducing a potential of the disappearance of the rotating band. Consequentially, it is important to keep the rifling rate to monotonously increase in the actual manufacturing process.

As can be seen in FIG. 7, in a design of the Fourier approach, the rifling rate increases and then decreases again. However, a phenomenon such as above does not appear in a design presented in the embodiment of the present invention.

Figure 8:
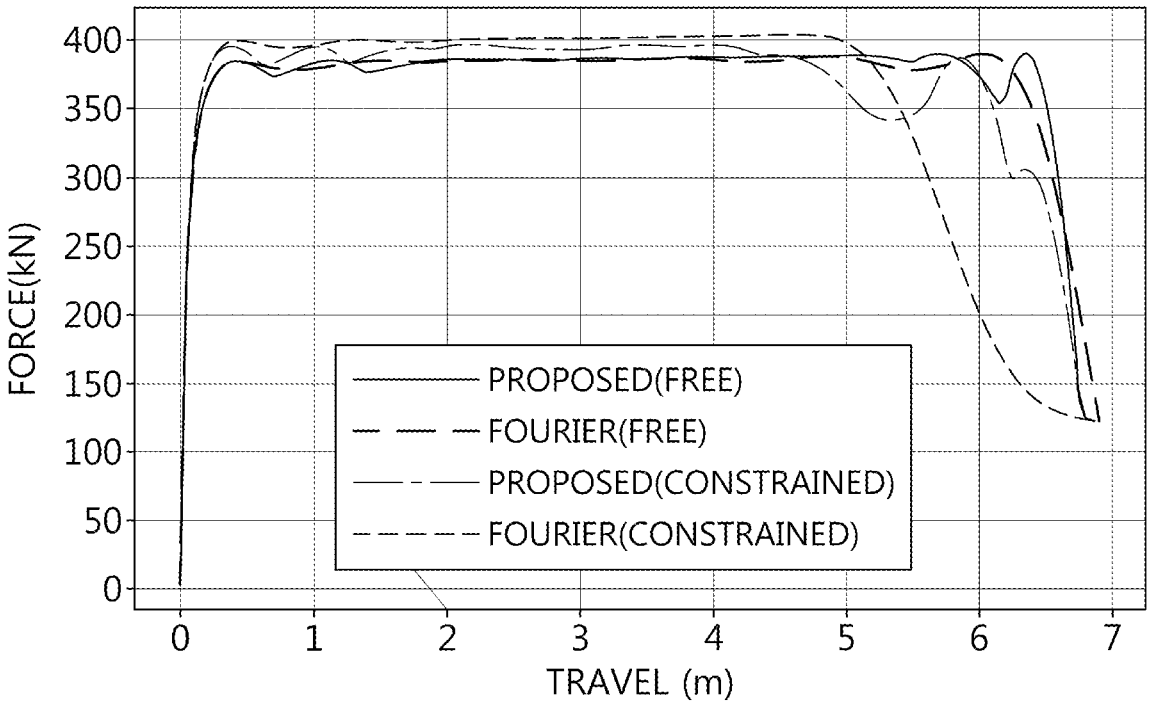
FIG. 8 is a graph comparing rifling force profiles each according to a general methodology or an embodiment of the present invention.

FIG. 8 is a graph comparing rifling force profiles each according to a general methodology or an embodiment of the present invention. With reference to FIG. 8, presented is a result comparing the rifling force profiles each according to the Fourier function approach (Fourier (free)) or the node-point-based method (proposed (free)) of an embodiment of the present invention. In addition, presented also is a result comparing the rifling force profiles each according to the Fourier function approach (Fourier (constrained)) or the node-point-based method (proposed (constrained)) of an embodiment of the present invention. As can be seen, the proposed method has, on the whole, a slightly smaller or similar rifling force compared with the conventional method. Accordingly, the proposed method may be regarded as having an effect of reducing the rifling force to a certain degree.

Figure 9:
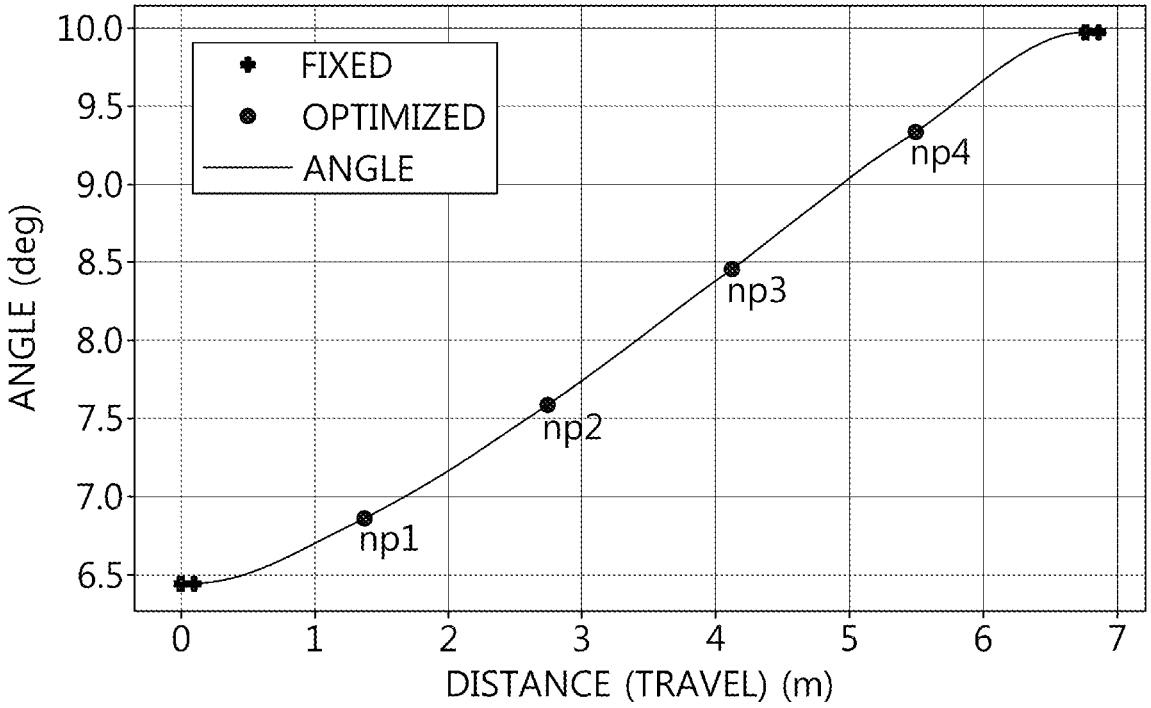
FIG. 9 is a graph illustrating a node arrangement and a rifling rate profile when the number of nodes is small according to an embodiment of the present invention.

FIG. 9 is a graph illustrating a node arrangement and a rifling rate profile when the number of nodes is small according to an embodiment of the present invention. With reference to FIG. 9, it is illustrated that the number of nodes (np1 to np4) is adjusted, thereby adjusting the curvature of the profile. When a small number of nodes are used, a rifling rate profile with a low curvature may be yielded. Though the curvature may also be adjusted when a specific coefficient is controlled in a rifling rate design by the methodology of the Fourier approach, there is a problem in this case that monotone increasing of the rifling rate may not be guaranteed as mentioned above. Such curvature adjustment is performed according to the processing accuracy in the actual manufacturing process, whereby the problem may be solved.

Figure 10:
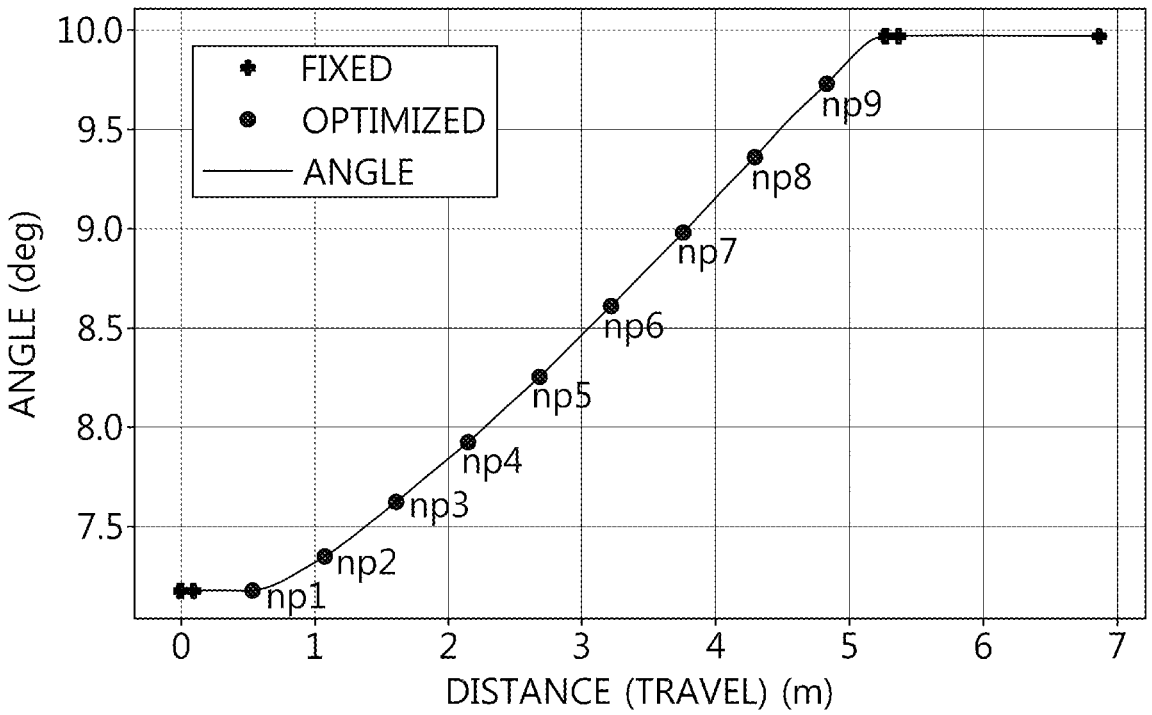
FIG. 10 is a graph illustrating a node arrangement and a rifling rate profile when fixed points are added according to an embodiment of the present invention.

FIG. 10 is a graph illustrating a node arrangement and a rifling rate profile when fixed points are added according to an embodiment of the present invention. With reference to FIG. 10, it is also possible to generate a profile that necessarily passes through specific points by fixing nodes to desired positions, as illustrated in FIG. 10. Subsequently, the nodes can be utilized in case of adding a partially fixed type rifling from the vicinity of the muzzle for the stability of a projectile behavior.

Moreover, the steps of a method or an algorithm described in connection with the embodiments disclosed herein may be embodied in a form of program instructions, which may be carried out through various computer means such as a microprocessor, a processor, a central processing unit (CPU), and the like. Then the steps may be recorded in a computer readable medium. The computer readable medium may include a program (instruction) code, a data file, a data structure, and the like, alone or in combination.

The program (instruction) codes to be recorded on the medium may be specially designed and constructed for the present invention or may be known to or available to those who have ordinary knowledge in the field of computer. Examples of the computer readable media may include magnetic media such as a hard disk, a floppy disk, and a magnetic tape; optical media such as a CD-ROM, a DVD, a Blu-ray, and the like; and a semiconductor memory device specifically configured to store and execute a program (instruction) code such as a ROM, a RAM, a flash memory, and the like.

Here, examples of the program (instruction) code may include a high-level language code executable by a computer using an interpreter or the like as well as a machine language code such as one produced by a compiler or the like. The hardware devices described above may be configured to operate with one or more software modules in order to perform the operation of the present invention, and vice versa.

What is claimed is:

1. An apparatus for designing a rifling rate to increase a lifespan of a gun barrel, the apparatus comprising:

a node selection module selecting and distributing a predetermined number of node points according to preset constraints between preselected starting and end rifling angles;

a sorting module sorting distributed node points; and a profile generation module calculating a rifling rate curve using sorted node points, and generating a rifling rate profile using the rifling rate curve.

2. The apparatus of claim 1, further comprising:

an evaluation module capable of determining how much the generated rifling rate profile reduces maximum rifling force from the preset maximum rifling force.

3. The apparatus of claim 1, wherein the distributed node points are randomly arranged at the beginning and then re-sorting thereof is performed.

4. The apparatus of claim 3, wherein the re-sorting is to arrange the distributed node points being randomly arranged in order of size.

5. The apparatus of claim 1, wherein, by applying a piecewise cubic Hermite interpolating polynomial (PCHIP), the rifling rate curve has node points where a slope is given to be continuous at an individual node point and has a characteristic that monotone increasing is guaranteed.

6. The apparatus of claim 1, wherein the constraints are each that slopes of the starting and end rifling angles are zero.

7. The apparatus of claim 1, wherein the sorting is accomplished by applying a covariance matrix adaptation-evolutionary strategy (CMA-ES) algorithm.

8. The apparatus of claim 1, wherein the rifling rate profile passes through node points fixed at specific positions predetermined to add a partially fixed type rifling from the vicinity of the muzzle.

9. A method for designing a rifling profile to increase a lifespan of a gun barrel, the method comprising:

selecting and distributing the predetermined number of node points according to preset constraints between preselected starting and end rifling angles by a node selection module;

sorting distributed node points by a sorting module; and calculating a rifling rate curve using sorted node points, and generating a rifling rate profile using the rifling rate curve by a profile generation module.

* * * * *